United States Patent [19]

Becker

[11] Patent Number: 4,943,023

[45] Date of Patent: Jul. 24, 1990

[54] DAM SUPPORT BRACKET FOR MASONRY CONSTRUCTION

[76] Inventor: Samuel R. Becker, 4336 Eastwood Dr., Sarasota, Fla. 34232

[21] Appl. No.: 323,954

[22] Filed: Mar. 15, 1989

[51] Int. Cl.[5] ..... E04G 17/00

[52] U.S. Cl. ..... 248/302; 249/219.2

[58] Field of Search ..... 248/302, 303, 74.2, 248/71, 218.1, 218.2, 218.3; 24/296, 546, 566, 555, 67.11; 52/514, 357, 358, 383, 379, 127.3, 127.4; 249/219.2, 215, 208, 19

[56] References Cited

U.S. PATENT DOCUMENTS

| | | | |
|---|---|---|---|
| 789,524 | 5/1905 | Bradley | 248/218.1 |
| 1,109,568 | 9/1914 | Flagge | 248/71 |
| 1,361,315 | 12/1920 | Dietrichs | 249/219.2 |
| 1,750,694 | 3/1930 | St. John | 248/71 |
| 2,318,182 | 5/1943 | Place | 24/296 |
| 2,885,168 | 5/1959 | Silverman | 248/71 |
| 3,722,164 | 3/1973 | Schmidgall | 24/546 |
| 4,201,013 | 5/1980 | Robbins | 24/546 |
| 4,232,847 | 11/1980 | Cooper | 248/302 |

FOREIGN PATENT DOCUMENTS

| | | | |
|---|---|---|---|
| 505702 | 9/1954 | Canada | 52/357 |
| 1335798 | 7/1963 | France | 248/71 |

*Primary Examiner*—Ramon O. Ramirez
*Assistant Examiner*—Robert A. Olson
*Attorney, Agent, or Firm*—Charles J. Prescott

[57] ABSTRACT

A bracket for temporarily securing a flat plate against a slide of a concrete block of a wall, the plate for covering an inspection hole formed in the side of the concrete block used for inspecting reinforcements within a cavity in the concrete block before being filled with concrete. The bracket is generally shaped like an inverted "L" fabricated of rigid, slender material such as metal wire or the like. The upright leg of the inverted "L" is structured to be inserted into the inner cavity of a concrete block, while the horizontal leg extends outwardly through mortar between two stacked concrete blocks. The exposed end of the horizontal leg is structured to supportively receive and releasably retain, in conjunction with at least one other such adjacent bracket, a rigid bar horizontally disposed adjacent the exposed side of a plate. This arrangement allows a wedge to be then driven between the bar and the plate to secure the plate against the concrete block, thus covering the inspection hole while concrete is poured into the cavity.

6 Claims, 3 Drawing Sheets

DAM SUPPORT BRACKET FOR MASONRY CONSTRUCTION

BACKGROUND OF THE INVENTION

This invention is related generally to construction of concrete block walls, and more particularly to a bracket used to facilitate easy inspection of inner reinforcements within the cavity of concrete blocks prior to filling those block cavities with concrete.

Presently, concrete walls are permanently secured to foundations, footings or concrete slabs by interconnecting the wall to steel reinforcement rods which have been embedded in these foundations, which reinforcements upwardly extend therefrom. These reinforcements upwardly extend a short distance into the cavity of one of the concrete blocks in the first or second lowest row of concrete blocks. However, an extension of these reinforcements is permanently secured by wiring or welding to the reinforcement embedded in the foundation. Thereafter, the column of cavities aligned in the successive rows of concrete blocks forming the wall is filled with concrete to effect a permanent rigid connection between the foundation and the concrete block wall around the reinforcement.

Prior to filling the continuous series of cavities which surround the upwardly extending reinforcement rod and its extension, a building inspector is generally required to insure that the connection between the reinforcement rod embedded and extending from the foundation is properly and permanently connected to the upward extension thereof. This inspection requires that an inspection hole be hammered through at least one side of the concrete block within which this reinforcement connection is positioned. After inspection, the inspection hole must be dammed up prior to concrete being poured into the cavity column surrounding the reinforcment rod.

Because the column of concrete poured into the cavity column and around the reinforcment rod is at least 6 feet to 8 feet high and the inspection hole is generally in the lowest row of concrete blocks, a significant amount of static pressure is applied to the dam used to cover the inspection hole. Typically, a plate of wood is placed against the side of the concrete block over the inspection hole and timbers are wedged against the plate held in place by stakes driven into the ground. Alternate jury rigged arrangements are also used.

None of the devices now known to applicant are fully reliable. Additionally, should further inspections be required because the concrete pour is delayed or for other reasons, dismantling these jury-rigged dams is burdensome at best and, where an entire building is ready for these concrete pourings, a significant amount of time may be lost where several inspection holes must be reaccessed for reinspection.

Another difficulty is encountered in multi-story structures where a second reinforcing member junction must be effected in the vicinity of the second and subsequent floor levels. Damming inspection holes at such a height above the ground becomes extremely difficult at best.

The present invention provides a very convenient and economical means for securing the plate over the inspection hole during pouring of the concrete within the cavity column surrounding the reinforcing member. The invention is readily adapted for use either in conjunction with the first row of concrete blocks atop the footing, foundation or slab, as well as at any level thereabove in conjunction with multi-story structures. Additionally, the present invention may be alternately structured to secure plates against inspection apertures where inspections must be made from both sides of a particular concrete block.

BRIEF DESCRIPTION OF THE INVENTION

This invention is directed to a bracket for temporarily securing a flat plate against a side of a concrete block of a wall, the plate for covering an inspection hole formed in the side of the concrete block used for inspecting reinforcements within a cavity in the concrete block before being filled with concrete. The bracket is generally shaped like an inverted "L" fabricated of rigid, slender material such as metal wire or the like. The upright leg of the inverted "L" is structured to be inserted into the inner cavity of a concrete block, while the horizontal leg extends outwardly through mortar between two stacked concrete blocks. The exposed end of the horizontal leg is structured to supportively receive and releasably retain, in conjunction with at least one other such adjacent bracket, a rigid bar horizontally disposed adjacent the exposed side of a plate. This arrangement allows a wedge to be then driven between the bar and the plate to secure the plate against the concrete block, thus covering the inspection hole while concrete is poured into the cavity.

It is therefore an object of this invention to provide a convenient and economical means for securing plates against and covering inspection holes formed into concrete blocks of walls under construction for inspection of reinforcment rods contained within these concrete blocks.

It is another object of this invention to provide a bracket which facilitates easy and correct dismantling and reassembly of the plate against the inspection hole should reinspection be required.

It is another object of this invention to provide a double ended bracket which satisfies the above objects.

In accordance with these and other objects which will become apparent hereinafter, the instant invention will now be described with reference to the accompanying drawings in which:

DETAILED DESCRIPTION OF THE INVENTION

Figure 2:
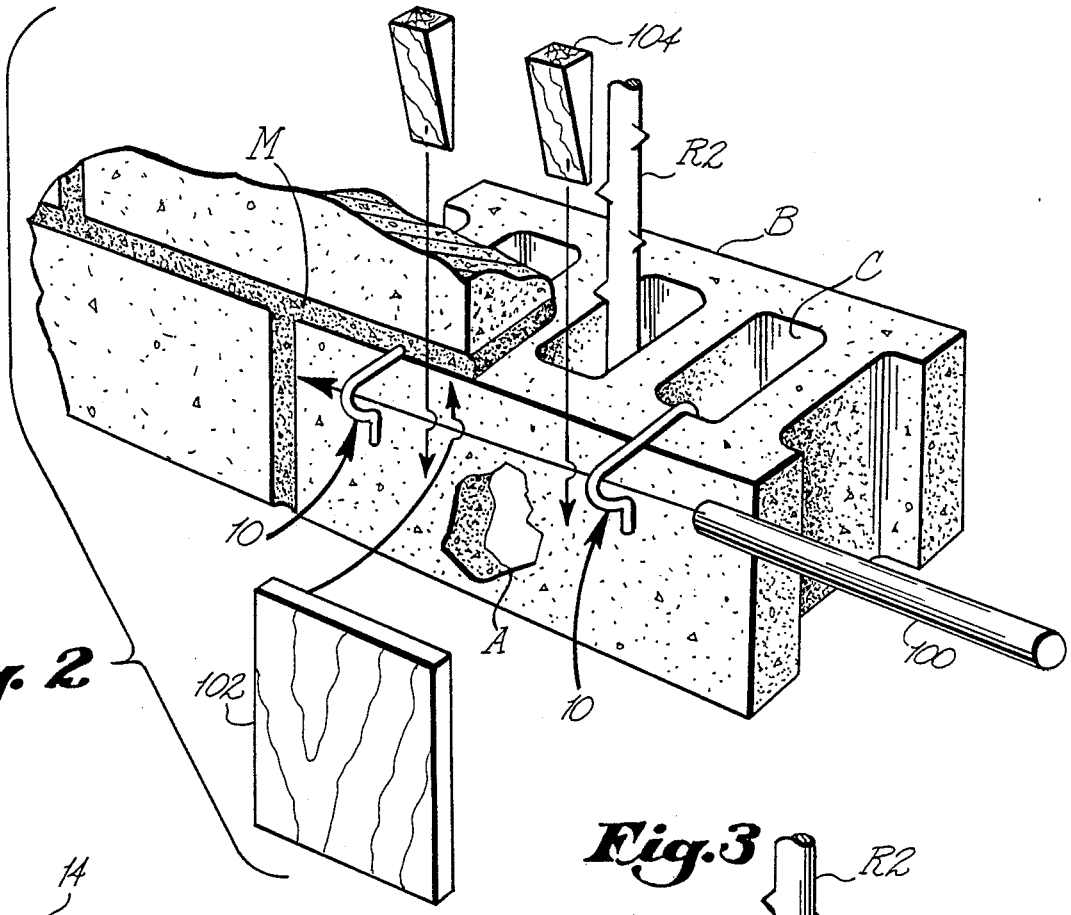
FIG. 2 is an exploded perspective view of the invention of FIG. 1 in use.
Figure 1:
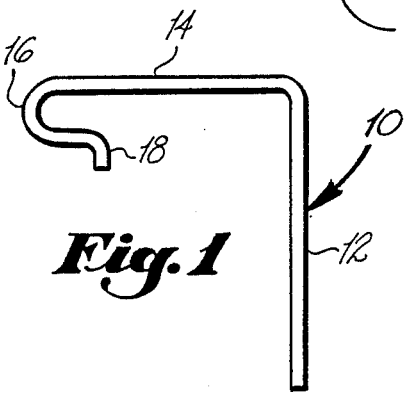
FIG. 1 is a side elevation view of the preferred embodiment of the invention.
Figure 3:
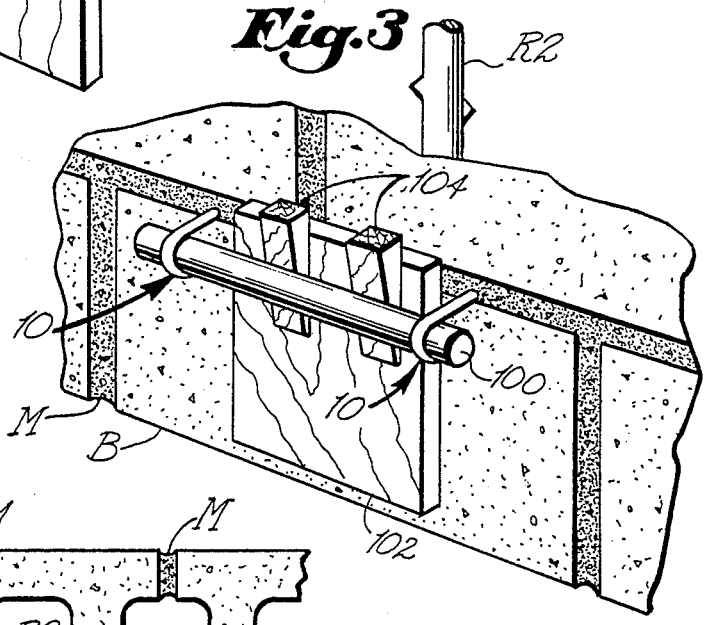
FIG. 3 is an assembled view of FIG. 2.
Figure 4:
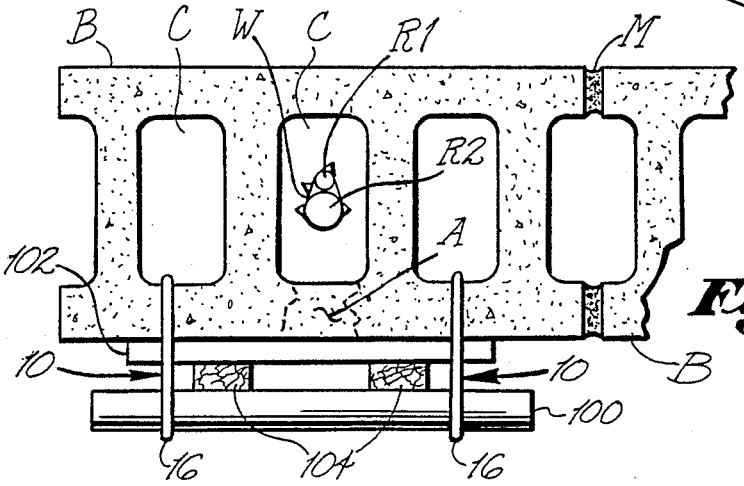
FIG. 4 is a top plan view of FIG. 3.
Figure 5:
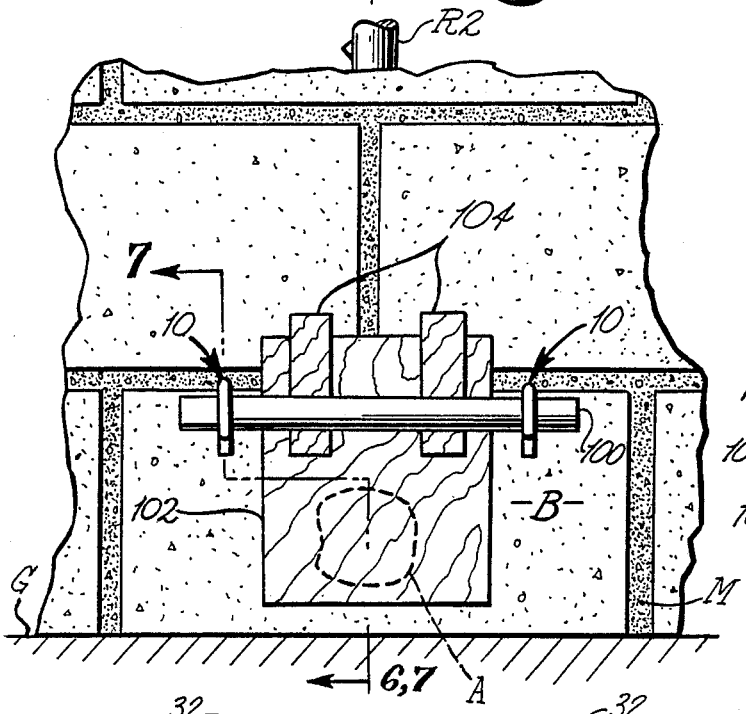
FIG. 5 is a side elevation view of FIG. 3.
Figure 6:
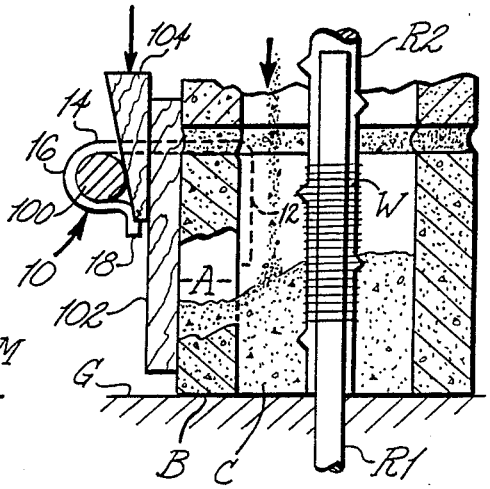
FIG. 6 is section view in the direction of arrows 6—6 in FIG. 5.

Referring now to the drawings, and particularly to FIGS. 1 to 7, the preferred embodiment of the invention is shown generally at numeral 10 as best seen in FIG. 1. This bracket 10 is formed of slender, rigid steel wire having a generally inverted "L"-shaped configuration as shown. The upright leg 12 is sized to fit within a cavity C of a conventional concrete block B. The generally horizontal leg 14 is sized to outwardly extend from cavity C and the side of concrete block B and to remain partially embedded within the mortar M between adjacent stacked concrete blocks B as best seen in FIGS. 2 and 6.

As best seen in FIGS. 2, 4, 5 and 6, an inspection hole A is typically hammered or formed into the side of the concrete block B which houses within one of its cavities C reinforcements rods R1 and R2. Reinforcement rod 1 is embedded within the foundation or concrete slab G when poured and extends upwardly therefrom a short distance, typically the length of the height of one or two concrete blocks B. As the concrete blocks B are mortared into place atop the foundation G to form walls, an extending reinforcement rod R2 is interconnected to rod R1 by wire W, welding or the like to effect permanent and rigid interconnection there between.

After the entire wall arrangement formed of concrete blocks B is complete, a column of concrete is then poured into the column of cavities C which surround the entire length of reinforcement rods R1, R2. When cured, this concrete secures the wall to the foundation G. However, building inspection code requires that the permanent interconnection W between reinforcement rods R1 and R2 be inspected prior to the pouring of the concrete. Thus, inspection hole A is provided for this purpose.

After this inspection has been completed, the column of concrete within the previously described column of cavities C is then poured. However, inspection hole A must be dammed up so as to prevent the escape of concrete. Obviously, then, the concrete also repairs the hole resulting by the formation of inspection of aperture A.

In order to effect damming of inspection hole A, a flat wooden plate 102 must be securely held against the side of the concrete block B to cover inspection hole A.

Brackets 10, having been previously secured in place within the cavity C of concrete block B as previously described, are securely retained in position by the hardened mortar M. The end of the horizontal leg 14 includes a reverse bend 16 forming a generally horizontal "U" which is structured to slidably receive an elongated rigid support bar 100 between two adjacent brackets 10 as best seen in FIGS. 2, 3, 4, and 5. These two brackets 10 cooperate to retain bar 100 in a horizontal orientation adjacent and spaced apart from the exposed surface of plate 102. By this arrangement, then, wedges 104 may be then driven between bar 100 and plate 102 by downwardly hammering the wedges 104 in the direction of the arrows as best shown in FIG. 6.

Because of the configuration of the bracket 10, the reverse bend 16 securely retains bar 100 so that a significant retaining force is exerted against plate 102 to withstand the weight of the column of concrete poured into the column of cavities C as previously described.

It should be now clearly understood that removal of the wedges 104, bar 100 and then plate 102 is an extremely simple procedure to expose the inspection hole A for an initial or subsequent inspection of the reinforcing rods' connection W.

Figure 7:
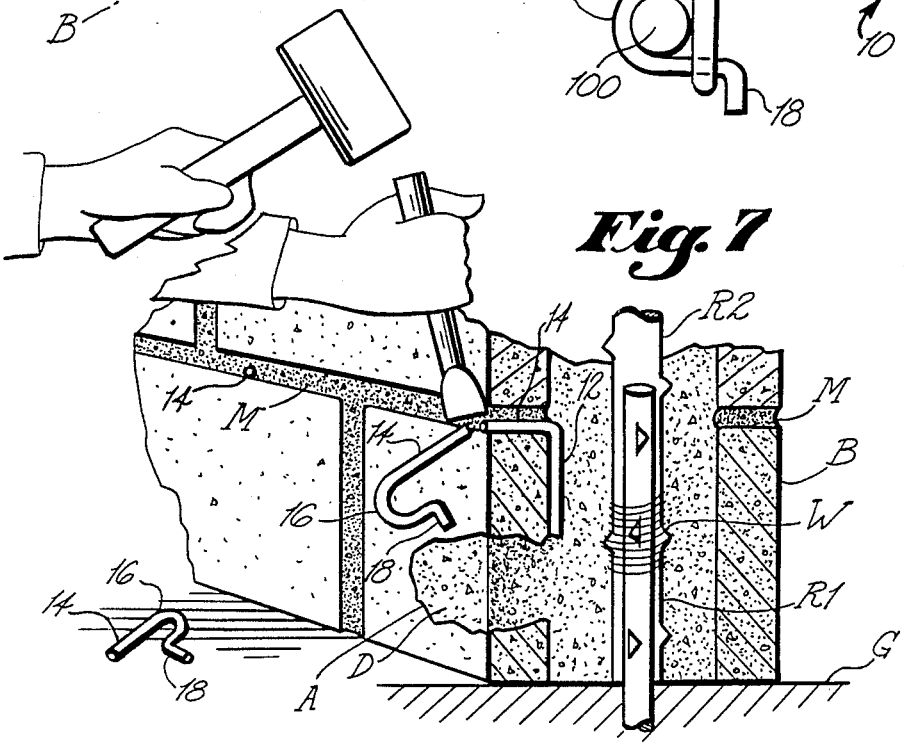
FIG. 7 is a perspective section view in the direction of arrows 7—7 in FIG. 5.

After the column of concrete within cavities C is hardened and cured, the wedges 104, the bar 100 and plate 102 may be quickly removed. Thereafter, as best seen in FIG. 7, a chisel or the like or separately, a cutting wheel may be used to sever the exposed portion of horizontal leg 14 and reverse bend 16 leaving the remainder of the horizontal leg 14 and the upright leg 12 permanently embedded within the mortar M and the hardened concrete D.

Figure 8:
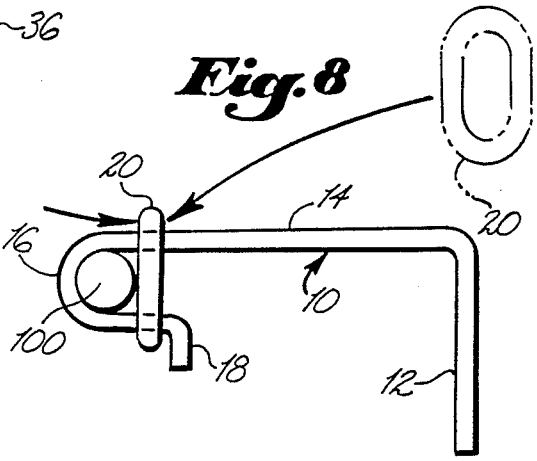
FIG. 8 is a side elevation view of another embodiment of the invention depicting an additional strengthening ring for use in conjunction with the bracket as shown in FIG. 1.

In situations where a taller column of concrete is to be poured within cavities C, the static pressure placed against plate 102 to dam over inspection hole A may be of sufficient magnitude so as to deform the reverse bend 16. In this situation, an additional tang 18 is provided as best seen in FIGS. 1 and 8. This tang 18 serves as a stop in conjunction with a continuous rigid ring 20 as best seen in FIG. 8. The tang 18 and ring 20 are sized such that bar 100 snuggly fits within the reverse bend 16 against ring 20. Thus, ring 20 substantially inhibits the defermation of the reverse bend area 16 as outward pressure is placed against bar 100 by the static weight of the concrete attempting to exit inspection hole A against plate 102.

Figure 9:
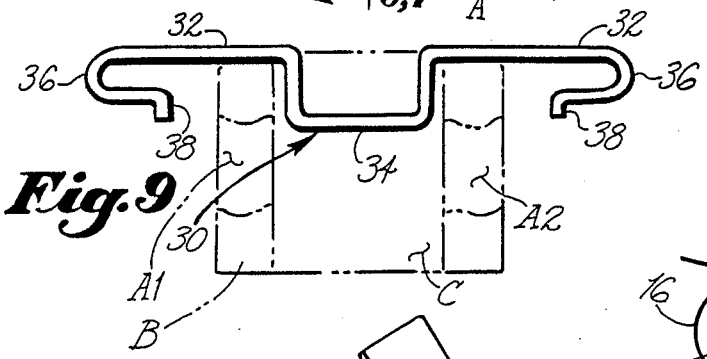
FIG. 9 is a side elevation view of a double-ended embodiment of the invention in conjunction with a concrete block shown in phantom.

Referring now to FIG. 9, occasionally inspection holes are required in both sides of the concrete block B shown in phantom at A1 and A2. In such situations, an alternate embodiment of the invention is provided as shown generally at numeral 30. This embodiment 30 is, likewise, preferably formed of rigid, slender steel wire and includes a generally "U-shaped" mid-portion at 34 and outwardly extending horizontal legs 32. These horizontal legs 32 include reverse bends at 36 and tangs 38 which are structured and function as previously described. The U-shaped mid-portion 34 is sized to snuggly fit within and span cavity C as shown allowing horizontal legs 32 to outwardly extend beyond the sides of the concrete block and to receive the horizontal bar 100 acting on plate 102 by wedges 104 as previously described.

Figure 10:
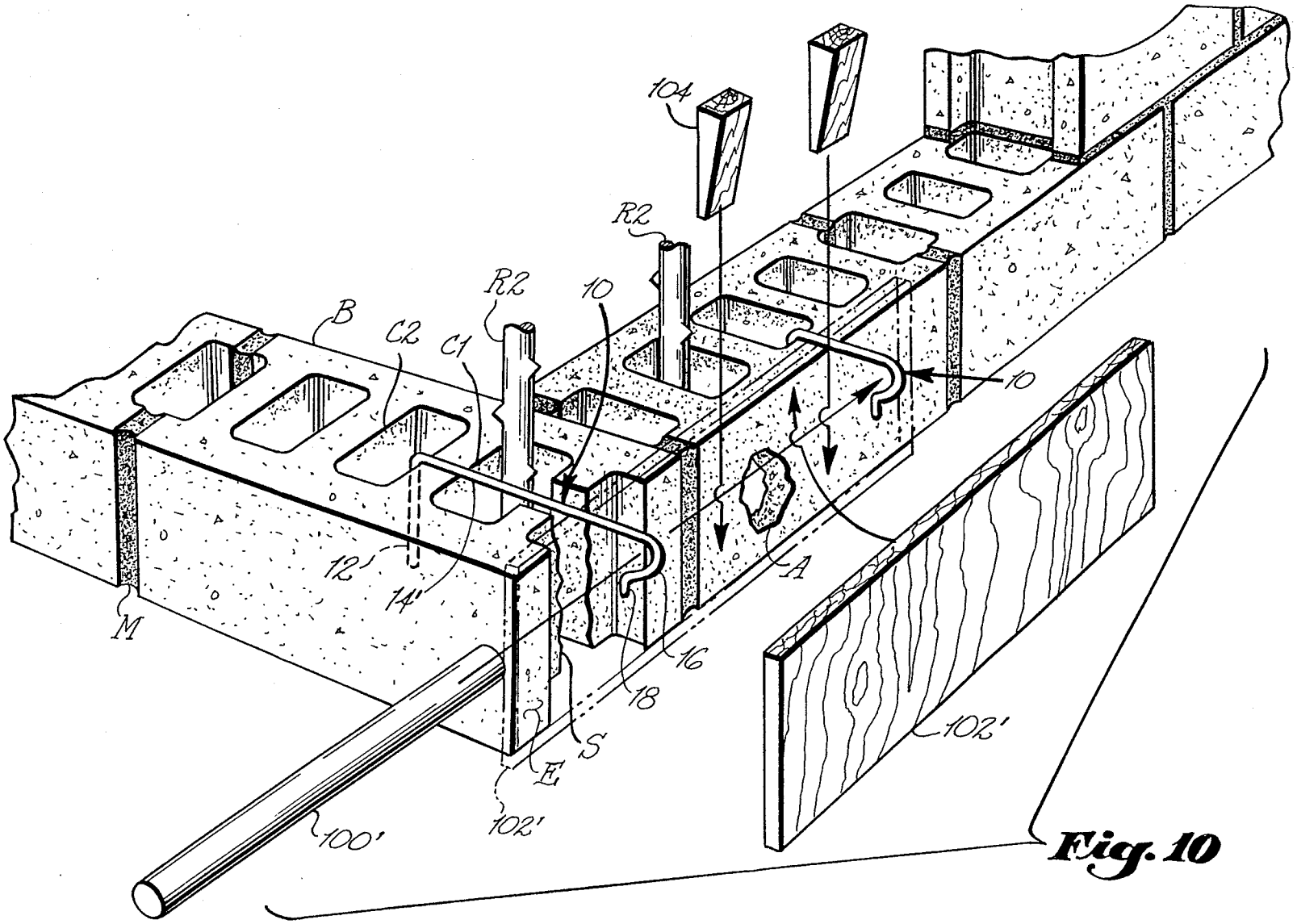
FIG. 10 is an exploded perspective view of an alternate size embodiment of the invention in use.

Referring lastly to FIG. 10, occasionally inspection holes are also required to be formed into an end E of a concrete block B. In these situations, a slot S is formed into the central portion of the end E of the block as shown. To accommodate the reinforcing rods R1 (not shown) and R2 being disposed in the end cavity C1, an alternate version of the preferred embodiment of the invention as shown at 10' must be utilized. This embodiment 10' is substantially the same at 12, 16, and 18 as previously described with regard to FIG. 1. However, this embodiment 10' includes an elongated horizontal leg 14' such that vertical leg 12 reaches to and extends downwardly into the middle cavity C2 as shown. The preferred embodiment of the invention 10 is utilized in cooperation with this alternate configuration 10' to support bar 100', elongated plate 102', and wedges 104 in the matter previously described.

Plate 102' and bars 100' are elongated in this situation in FIG. 10 to depict the additional coverage of a second aperture A formed into the side of another concrete block B to be covered during concrete pouring into the cavity columns which house reinforcing rods R1 and R2 as previously described.

While the instant invention has been shown and described herein in what is conceived to be the most practical and preferred embodiment, it is recognized that departures may be made therefrom within the scope of the invention, which is therefore not to be limited to the details disclosed herein, but is to be accorded the full scope of the claims so as to embrace any and all equivalent apparatus and articles.

I claim:

1. A bracket for temporarily securing a plate against a side of a concrete block of a wall, the concrete block having an inspection hole formed in its side exposing a cavity within the concrete block which is to be temporarily covered by the plate while concrete is poured into, and hardens within the cavity, the said bracket comprising:

a contoured length of rigid, slender, elongated material lying in a plane and formed into an inverted "L" configuration having negligible flexure and having an upright leg and a generally horizontal leg;

said upright leg structured to be inserted into the cavity adjacent the inspection hole;

said horizontal leg extending outwardly from said upright leg and the cavity between two stacked concrete walls and to be retained in this position by mortar between the concrete blocks;

said horizontal leg having a reverse bend at its distal end through about 180 degrees in the direction of said upright leg, presenting another leg generally parallel to said horizontal leg, to releasably receive and retain a rigid, slender bar in general horizontal orientation against the exposed surface of the plate in cooperation with another adjacent said bracket similarly positioned in another cavity;

said horizontal leg sized to allow a wedge to be releasably driven between the bar and the plate to secure the plate against the concrete block to cover the inspection hole while the concrete hardens within the cavity;

said horizontal leg being severed at a portion thereof which is adapted to extend from the concrete block after the concrete hardens.

2. A bracket as set forth in claim 1, wherein:

said material is wire or the like.

3. A bracket as set forth in claim 1, further comprising:

a removable, rigid ring structured to slidably fit over said reverse bend, said distal end having a stop to position and retain said rim over said reverse bend when the rod is positioned within said reverse bend;

said ring for preventing deformation of said reverse bend when a column of concrete is poured into the cavity.

4. A bracket for temporarily securing a plate against an end of a concrete block of a wall, the concrete block having an inspection hole formed in its end exposing a cavity within the concrete block which is to be temporarily covered by the plate while concrete is poured into, and hardens within the cavity, the said bracket comprising:

a contoured length of rigid, slender, elongated material generally lying in a plane and formed into an inverted "L" configuration having negligible flexure and having an upright leg and a generally horizontal leg;

said upright leg structured to be inserted into the cavity adjacent the inspection hole;

said horizontal leg extending outwardly from said upright leg and the cavity between two stacked concrete walls and to be retained in this position by mortar between the concrete blocks;

said horizontal leg having a reverse bend at its distal end through about 180 degrees in the direction of said upright leg, presenting another leg generally parallel to said horizontal leg, to releasably receive and retain a rigid, slender bar in general horizontal orientation against the exposed surface of the plate in cooperation with another adjacent said bracket similarly positioned in another cavity;

said horizontal leg sized to allow a wedge to be releasably driven between the bar and the plate to secure the plate against the end of the concrete block to cover the inspection hole while the concrete hardens within the cavity;

said horizontal leg being severed at a portion thereof which is adapted to extend from the concrete block after the concrete hardens.

5. A bracket as set forth in claim 4, wherein:

said material is wire or the like.

6. A bracket as set forth in claim 4, further comprising:

a removable, rigid ring structured to slidably fit over said reverse bend, said distal end having a stop to position and retain said rim over said reverse bend when the rod is positioned within said reverse bend;

said ring for preventing deformation of said reverse bend when a column of concrete is poured into the cavity.

* * * * *